US006196835B1

(12) United States Patent
Gutmark et al.

(10) Patent No.: US 6,196,835 B1
(45) Date of Patent: Mar. 6, 2001

(54) BURNER

(75) Inventors: Ephraim Gutmark, Baton Rouge, LA (US); Christian Oliver Paschereit, Baden; Wolfgang Weisenstein, Remetschwil, both of (CH)

(73) Assignee: ABB Research Ltd., Zurich (CH)

( * ) Notice: Subject to any disclaimer, the term of this patent is extended or adjusted under 35 U.S.C. 154(b) by 0 days.

(21) Appl. No.: 09/434,448

(22) Filed: Nov. 5, 1999

(30) Foreign Application Priority Data

Nov. 18, 1998 (EP) ..... 98811145

(51) Int. Cl.[7] ..... F23D 14/46

(52) U.S. Cl. ..... 431/350; 431/114; 431/185; 431/351

(58) Field of Search ..... 431/114, 350, 431/173, 351, 353, 354, 182, 185; 60/725, 732, 748, 755

(56) References Cited

U.S. PATENT DOCUMENTS 5,129,226 7/1992 Bigelow et al. .
5,433,596 7/1995 Dobbeling et al. .
5,487,274 1/1996 Gulati et al. .
5,513,982 * 5/1996 Athaus ..... 431/351
5,676,538 10/1997 Lovett .
5,784,889 * 7/1998 Joos et al. ..... 431/114

FOREIGN PATENT DOCUMENTS

2262256 * 9/1975 (FR) ..... 431/114
WO98/11383 3/1998 (WO) .

* cited by examiner

*Primary Examiner*—James C. Yeung
(74) *Attorney, Agent, or Firm*—Burns, Doane, Swecker & Mathis, L.L.P.

(57) ABSTRACT

A burner for generating a hot gas including at least two hollow partial bodies stacked inside each other in a downstream air flow direction. The center axes of the hollow bodies extend offset to each other such that burner slits formed by adjoining walls of the partial bodies form tangential air inlet channels for an inflow of combustion air into an inside chamber defined by the partial bodies. The hollow bodies are provided with a plurality of baffles projecting into the downstream air flow. The plurality of baffles add an axial turbulence force to the air flow.

5 Claims, 6 Drawing Sheets

BURNER

FIELD OF THE INVENTION

The invention relates to a burner for operating an aggregate for generating a hot gas.

BACKGROUND OF THE INVENTION

Thermoacoustic oscillations pose a risk for any type of combustion applications. They cause pressure fluctuations with a high amplitude, restrict the operating range, and may increase the emissions associated with combustion. These problems occur in particular in combustion systems with low acoustic attenuation, as often represented by modern gas turbines.

In standard combustors, the coolant air flowing into the combustor acts in a sound-absorbing manner and in this way contributes in the attenuation of thermoacoustic oscillations. In order to achieve low $NO_x$ emissions, an increasing share of the air is conducted through the burners themselves in modern gas turbines, and the coolant air stream is reduced. The sound absorption associated with this causes the initially mentioned problems to occur more often in modern combustors.

One method of absorbing the sound consists of connecting Helmholtz dampers inside the combustor hood or near the coolant air supply. But given the tight space conditions typically found with modern combustors built in a compact manner, the arrangement of such dampers may be difficult, however, and may be associated with high constructive expenditure.

Another possibility is the control of thermoacoustic oscillations with active acoustic excitation. The shear layer that develops near the burner is hereby stimulated acoustically. With a suitable phase position between the thermoacoustic oscillations and the excitation, an absorption of the combustor oscillations can be achieved. Such a solution requires the attachment of additional elements near the combustor, however.

SUMMARY OF THE INVENTION

The invention is based on the objective of creating a device that permits an effective suppression of thermoacoustic oscillations and is associated with the lowest possible constructive expenditure.

Coherent structures play a critical role in mixing processes between air and fuel. The dynamics of these structures as related to space and time influence the combustion and heat release. The invention is based on the idea of interfering with the formation of coherent turbulence structures in order to reduce the periodic heat release fluctuation and therefore the amplitude of the thermoacoustic oscillations.

A burner according to the invention for operating an aggregate for generating a hot gas consists essentially of at least two hollow partial bodies stacked inside each other in the direction of the flow, the center axes of said hollow bodies extending offset to each other in such a way that at the burner slits, adjoining walls of the partial bodies form tangential air inlet channels for the inflow of combustion air into an inside chamber defined by the partial bodies. To add an axial turbulence force to the flow, the burner is provided according to the invention with a number of baffles projecting into the flow.

In a preferred embodiment, the baffles are arranged at the burner outlet. It was also found to be particularly advantageous if the burners are arranged both at the burner outlet and along the burner slits.

The baffles can have any conceivable shape. They may be either flat or a have a distinctly three-dimensional shape. They are advantageously constructed, for example, in a saw tooth structure, sinus shape or rectangular shape. It is particularly advantageous if the baffles are designed in the shape of turbulence generators. "Turbulence generator" hereby means a device that adds the axial turbulence force into a flow without generating a recirculation zone in a wake area.

The flow instabilities in the combustor usually have a dominant mode. The dampening of this dominant mode is necessary for suppressing thermoacoustic oscillations. The wavelength of the dominant mode of the instability is obtained from its frequency $f$ and the convection speed $u_c$ via $\lambda = u_c/f$. The relevant frequencies are between several 10 Hz and several kHz. The convection speed depends on the burner and typically is several 10 m/s, for example 30 m/s.

It was now found that the dominant mode is suppressed especially effectively if the distances s of adjoining baffle elements are smaller or about equal to half the wavelength of the dominant mode. This is true for the distance of baffles located along the burner outlet and also for elements located along the burner slits.

The invented introduction of turbulence force in axial direction in order to interfere with coherent turbulence structures by means of baffles projecting into the flow not only can be used for the double-cone burner described here but also with other types of burners.

BRIEF DESCRIPTION OF THE DRAWINGS

Other advantageous designs, characteristics, and details of the invention result from the secondary claims, the description of the embodiment, and the drawings. The invention is explained below using an exemplary embodiment in reference to the drawings. Only those elements essential for understanding the invention are shown in each case. Hereby:

DESCRIPTION OF THE PREFERRED EMBODIMENTS

Figure 1:
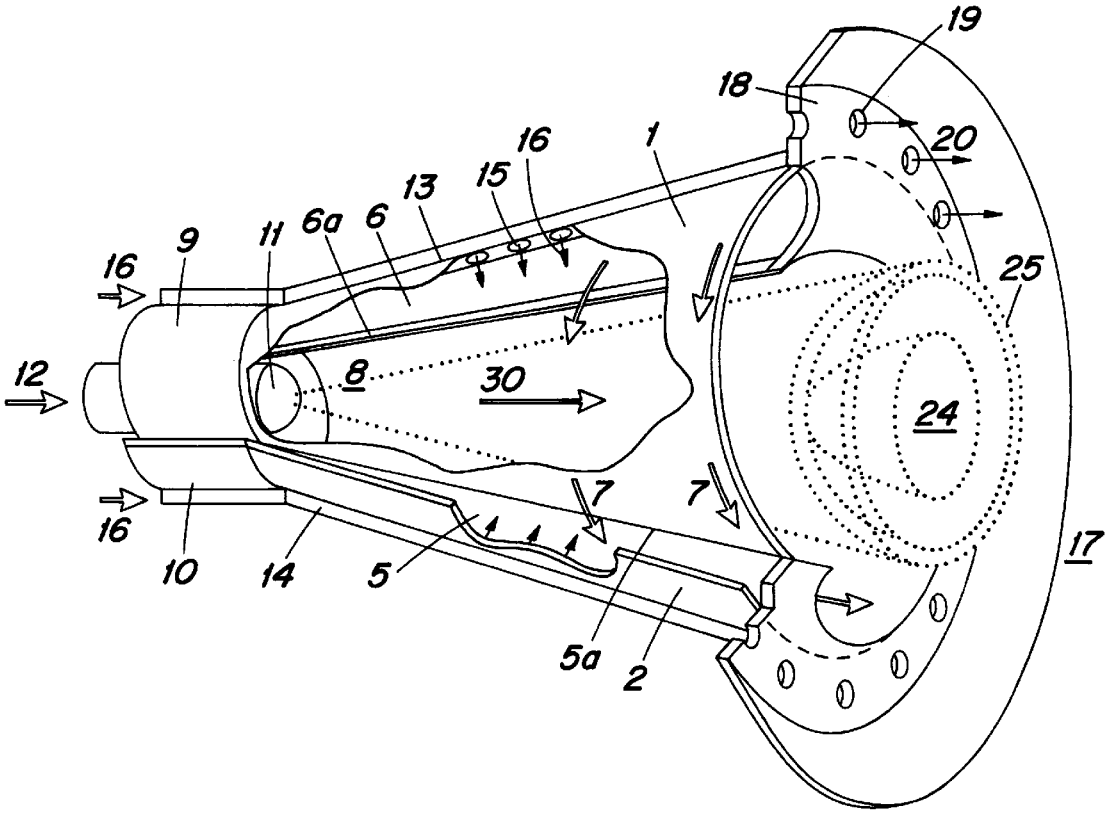
FIG. 1 shows a perspective view of a burner according to the state of the art sectioned accordingly.

FIG. 1 shows a known pre-mix burner consisting of two half, hollow partial conical bodies 1, 2 that are arranged offset to each other. The offset of the respective center axis of the partial conical bodies 1, 2 relative to each other creates on both sides, in mirror arrangement, one each tangential air inlet channel 5, 6 at the burner slits 5*a*, 6*a*, through which air inlet channel the combustion air 7 flows into the interior 8 of the burner. The partial conical bodies 1, 2 have cylindrical starting parts 9, 10 that contain a fuel nozzle 11 through which liquid fuel 12 is injected. The partial conical bodies 1, 2 furthermore have, as needed, one each fuel line 13, 14 that is provided with opening 15 through which gaseous fuel 16 is mixed into the combustion air 7 that flows through the tangential air inlet channels 5, 6.

On the combustion chamber side 17, the burner has a collar-shaped front plate 18 that functions as an anchor for the partial conical bodies 1, 2 and has a number of bores 19 through which dilution air or coolant air 20 can be supplied to the front part of the combustion chamber or its wall, if needed.

The fuel injection may be an air-assisted nozzle or a nozzle functioning according to the mechanical atomization principle. The conical spray pattern is enclosed by the tangentially inflowing combustion air streams 7. The concentration of the injected fuel 12 is continuously reduced in the direction of the flow 30 by the combustion air streams 7. If a gaseous fuel 16 is added near the tangential air inlet channels 5, 6, the formation of the mixture with the combustion air 7 starts already in this area. When using a liquid fuel 12, the optimum, homogeneous fuel concentration over the cross-section is achieved in the area where the turbulence bursts open, i.e., in the area of the flowback zone 24 at the end of the premix-burner. The ignition of the fuel/combustion air mixture starts at the tip of the flowback zone 24. A stable flame is only able to form at this point.

Figure 2:
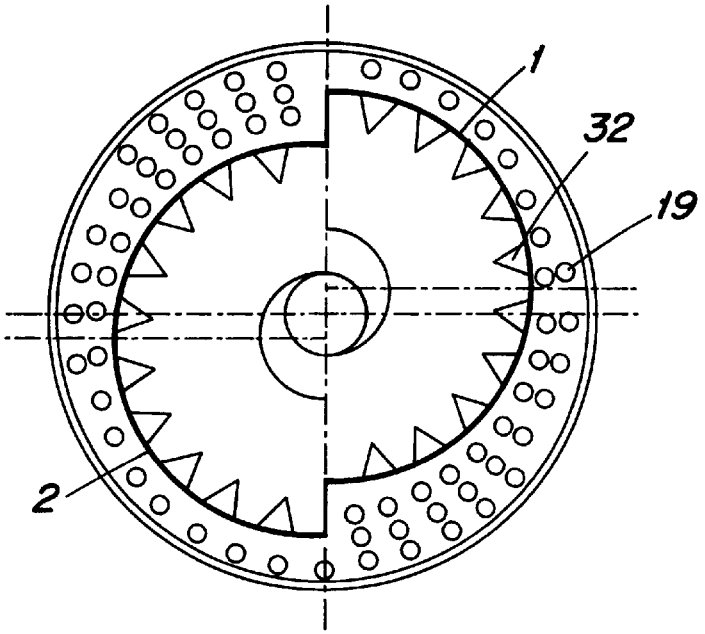
FIG. 2 shows a frontal view of an exemplary embodiment of a burner according to the invention.
Figure 5:
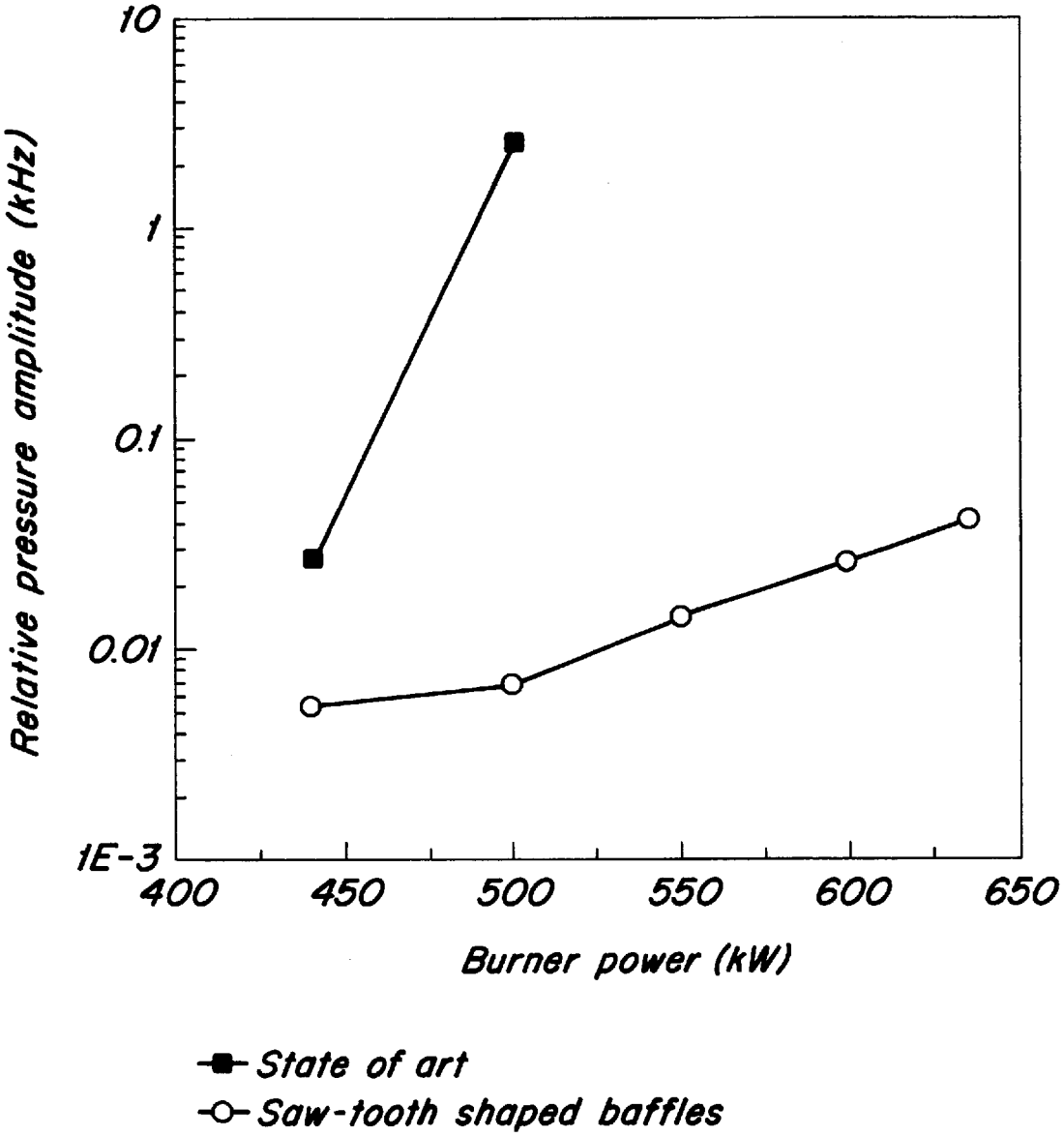
FIG. 5 shows a logarithmic application of the relative pressure amplitude in the kHz range in relation to the burner power for an unmodified burner according to the state of the art and for a burner according to the invention with saw-tooth-shaped baffles.

In an exemplary embodiment, ten triangular baffles 32 that overall form a saw-tooth-structure were fixed to the burner outlet on each partial conical bodies 1, 2 (FIG. 2). The dimensions of the structure hereby depend on the wavelength of the dominant mode of the flow instability to be suppressed, the frequency of which flow instability was in the exemplary embodiment in the kHz range. The experimental determination of the pressure fluctuations of FIG. 5 shows that the amplitude of the thermoacoustic fluctuations can be reduced with the baffles ("saw tooth baffles", open circles) by one to two magnitudes in comparison to a conventional burner ("unmodified, solid squares).

Figure 6:
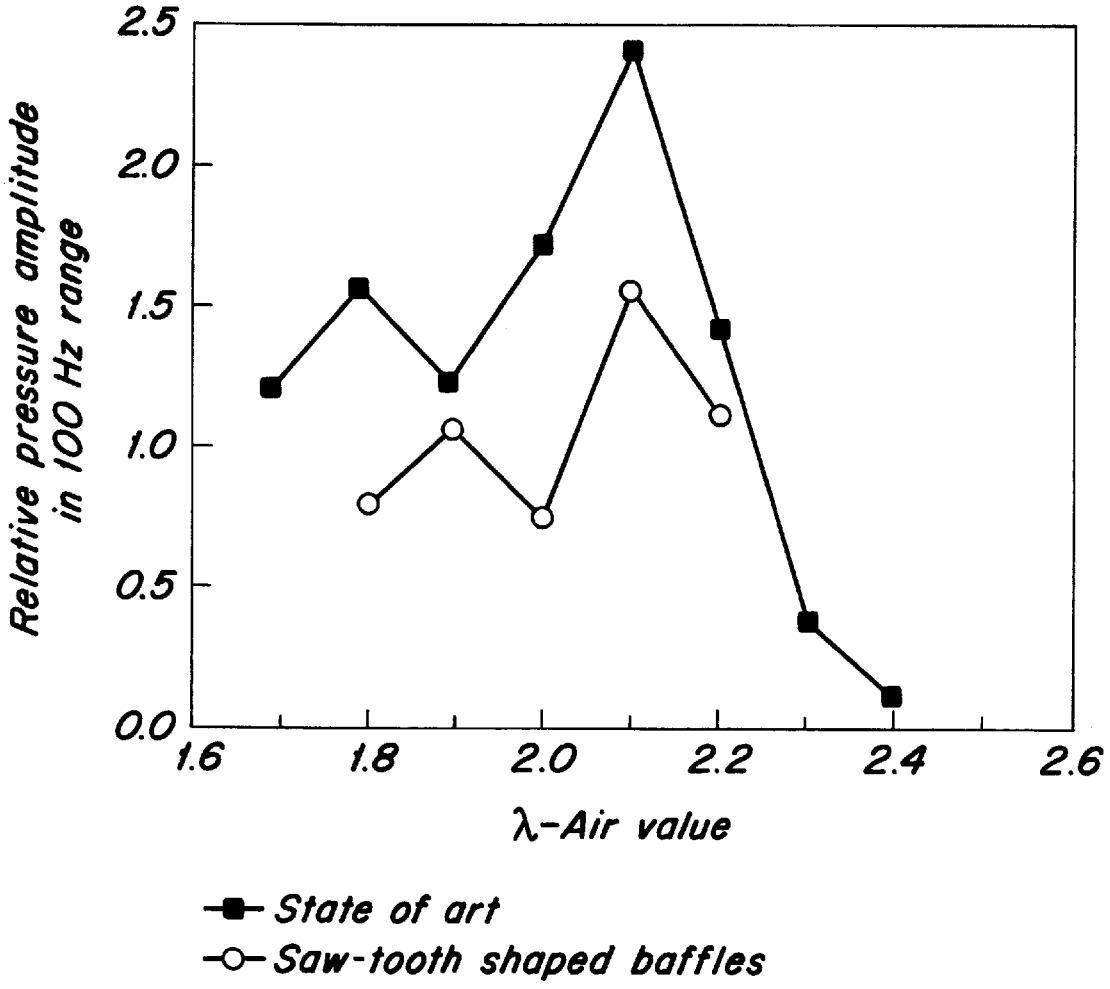
FIG. 6 shows an application of the relative pressure amplitude in the 100 Hz range in relation to the air value $\lambda$ for an unmodified burner according to the state of the art and for a burner according to the invention with saw-tooth-shaped baffles.

Although the dimensions of the baffles were designed for oscillations in the kHz range, the absorption effect of the baffles extends over a broad frequency range. FIG. 6 shows the results of an experimental determination of the pressure fluctuations in the 100 Hz range when using conventional burners ("unmodified", solid squares) and burners according to the previous exemplary embodiment of the invention ("saw tooth baffles, open circles) as a function of the air value $\lambda$. The air value $\lambda$ hereby is a measure for the ratio of the amount of air introduced into the combustion chamber that is theoretically required for the complete combustion. FIG. 6 shows that the invention at hand also still clearly reduced the amplitude of the pressure oscillations in the especially relevant range $1.8 \leqq \lambda \leqq 2.2$ in the 100 Hz range.

Figure 4A:
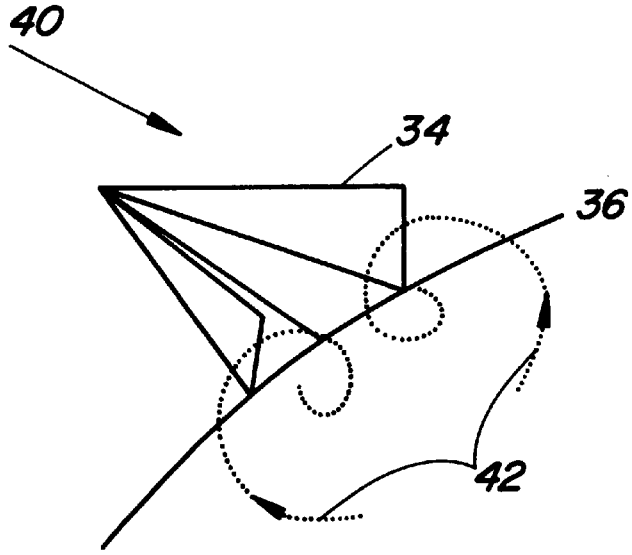
FIGS. 4*a–b* shows exemplary embodiments for turbulence generators for use in a burner according to the invention.
Figure 4B:
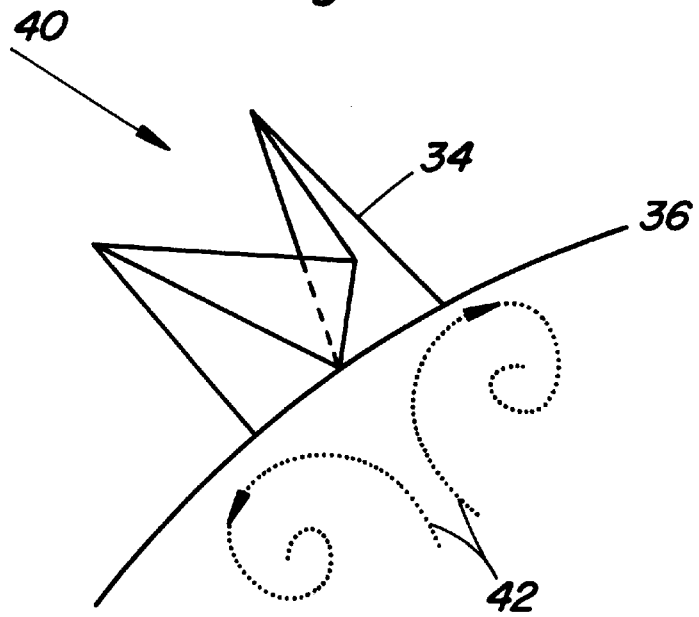

Instead of simple geometric baffles, turbulence generators 34 were used as baffles in other exemplary embodiments. FIGS. 4*a*–*b* show two embodiments of turbulence generators 34, each of which is arranged at the edge 36 of a partial conical body. Reference No. 40 designates the local flow direction of the working medium. The turbulence structures 42 generated by the turbulence generators 34 are each shown schematically. The turbulence generator shown in FIG. 4*b* in contrast generates a turbulence pair that rotates outward.

Figure 3:
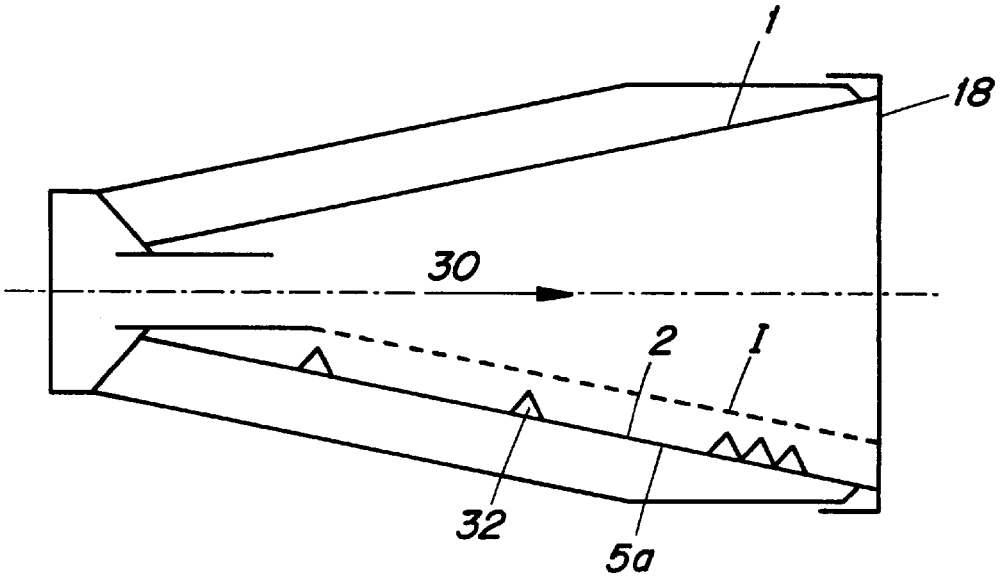
FIG. 3 shows a schematic side view of a burner according to the invention.

In one exemplary embodiment, twenty turbulence generators 34 were built into the burner. Ten of the turbulence generators were arranged at the burner outlet, as shown in FIG. 2, along the circumference of the of the partial conical bodies 1,2. Five each additional turbulence generators were attached, as shown in FIG. 3, along the burner slits 5*a*, 6*a*. The section of FIG. 3 hereby shows only one of the two burner slits.

Figure 7:
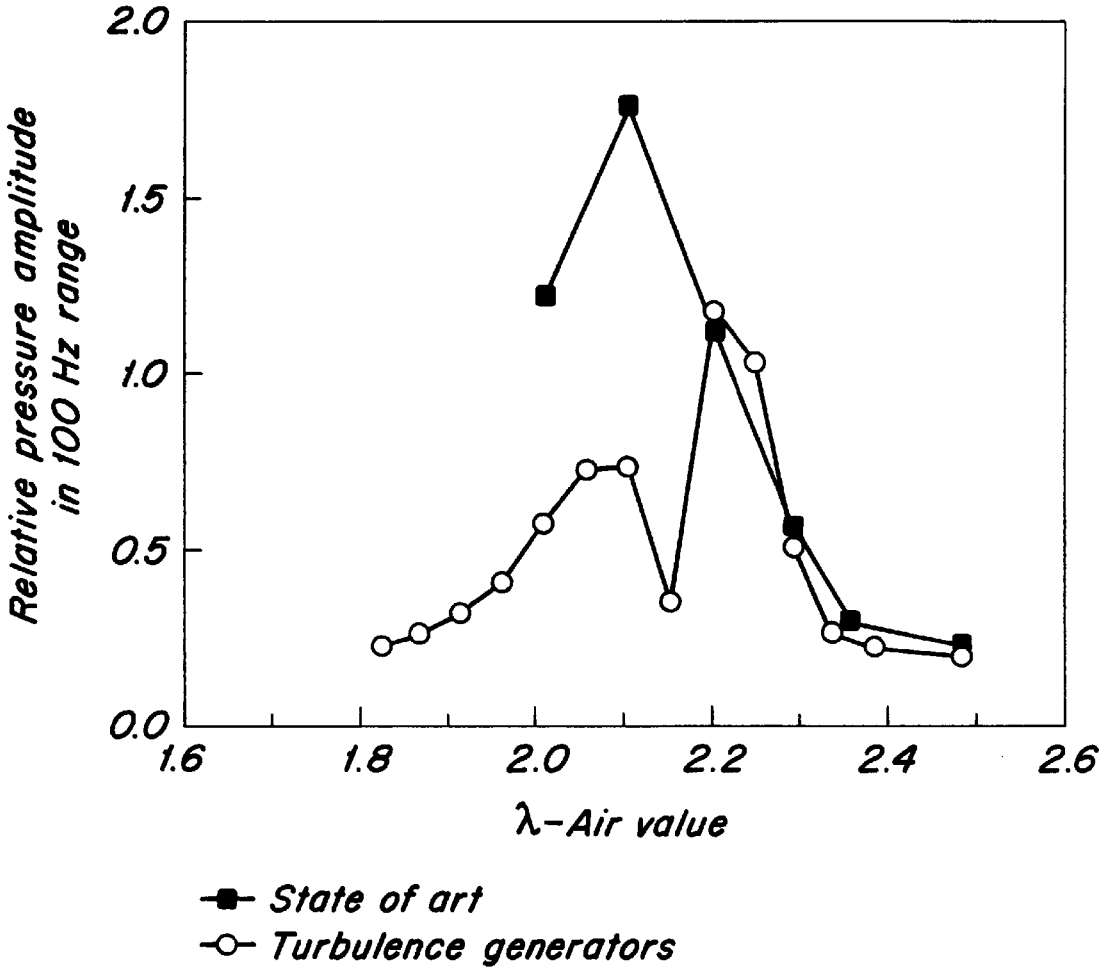
FIG. 7 shows an application of the relative pressure amplitude in the 100 Hz range in relation to the air value $\lambda$ for an unmodified burner according to the state of the art and for a burner according to the invention with turbulence generators.

FIG. 7 shows the results of an experimental determination of the pressure fluctuations in the 100 Hz range in relation to the air value $\lambda$ when using a conventional burner ("unmodified", solid squares) and a burner with the described arrangement of turbulence generators ("turbulence generators", open circles). Compared to an unmodified burner, the pressure fluctuations clearly reduced over a broad range of $\lambda \leqq 2.2$.

What is claimed is:

1. A burner for operating a unit for hot gas generation, comprising:

at least two hollow partial bodies stacked into each other in direction of flow;

the two partial bodies forming an internal space of the burner;

the center axes of said hollow bodies being offset relative to each other to form longitudinally extending inlet slots for a flow of combustion air into the internal space at burner slits; and a plurality of projecting flow disturbance elements disposed on the walls of the partial bodies at a burner outlet for introducing axial swirl into the flow, wherein the flow disturbance elements are arranged at a distance to one another.

2. The burner as claimed in claim 1, further comprising a plurality of flow disturbance elements disposed on the walls of the partial bodies along the burner slits.

3. The burner as claimed in claim 1, wherein the flow disturbance elements are constructed in a saw tooth structure.

4. The burner as claimed in claim 1, wherein the flow disturbance elements are turbulence generators.

5. A burner for operating a unit for hot gas generation, in which a flow in the burner it subject to flow instabilities, comprising:

at least two hollow partial bodies stacked into each other in direction of flow;

the two partial bodies forming an internal space of the burner;

the shape of the internal space defining a dominant mode of the flow instabilities, the dominant mode having a wavelength $\lambda$;

the center axes of said hollow bodies being offset relative to each other to form longitudinally extending inlet slots for a flow of combustion air into the internal space at burner slits; and a plurality of projecting flow disturbance elements disposed on the walls of the partial bodies at a burner outlet for introducing axial swirl into the flow, wherein neighboring flow disturbance elements are arranged at a distance of about $\lambda/2$ to one another.

* * * * *